US005161548A

United States Patent [19]

Neville

[11] Patent Number: 5,161,548

[45] Date of Patent: Nov. 10, 1992

[54] METHOD OF CONDITIONING TOBACCO AND APPARATUS THEREFORE

[75] Inventor: Richard E. G. Neville, Salisbury, England

[73] Assignee: GBE International plc, Andover, England

[21] Appl. No.: 476,384

[22] PCT Filed: Sep. 26, 1989

[86] PCT No.: PCT/GB89/01129

§ 371 Date: May 18, 1990

§ 102(e) Date: May 18, 1990

[87] PCT Pub. No.: WO90/03124

PCT Pub. Date: Apr. 5, 1990

[30] Foreign Application Priority Data

Sep. 26, 1988 [GB] United Kingdom ..... 8822574

[51] Int. Cl.[5] ..... A24B 3/04; A24B 3/12

[52] U.S. Cl. ..... 131/296; 131/304; 131/306

[58] Field of Search ..... 131/296, 306, 304, 290

[56] References Cited

U.S. PATENT DOCUMENTS 3,978,867 9/1976 Wochnowski ..... 131/306
4,195,647 4/1980 Wochnowski et al. ..... 131/296
4,932,424 6/1990 Liebe et al. .

FOREIGN PATENT DOCUMENTS 2401625 3/1979 France .
2026668 2/1980 United Kingdom .
2138666 10/1984 United Kingdom .
2146750 4/1985 United Kingdom .

*Primary Examiner*—Vincent Millin
*Assistant Examiner*—J. Doyle
*Attorney, Agent, or Firm*—Dowell & Dowell

[57] ABSTRACT

A method of conditioning tobacco including the steps of: a) vibrating tobacco particles by means of a vibratory conveyor to produce a continuous stream to be transferred along a predetermined path, the conveyor being vibrated in such a manner that the stream of tobacco particles remains in contact with the supporting surface of the conveyor during transportation; b) contacting substantially all of the particles of tobacco with steam by continuously passing steam upwardly through perforations in said conveyor; and c) maintaining said steam at a pressure sufficient to enable the steam to diffuse into the interstices between the particles without causing said stream of tobacco particles to be lifted out of contact with the supporting surface of the conveyor, wherein the steam passing by way of the perforations includes a component of flow parallel with the supporting surface of the conveyor.

7 Claims, 1 Drawing Sheet

METHOD OF CONDITIONING TOBACCO AND APPARATUS THEREFORE

BACKGROUND OF THE INVENTION

This invention concerns the conditioning of tobacco products, in particular the conditioning of cut lamina and cut mid rib (known as cut stem) by the introduction of steam to a vibratory conveyor wherein the steam passing by way of the perforations includes a component of flow parallel with the supporting surface of the conveyor.

It is well known to subject tobacco products to steam at atmospheric pressure after cutting and before drying in order to expand or puff the tobacco.

This can be achieved by any means which transports the tobacco in a given direction whilst subjecting it to a transverse flow of steam, but with varying effectiveness.

One means is a rotary cylinder with axis slightly inclined to the horizontal to transport the tobacco, enclosing a stationary pipe parallel with the axis carrying a number of steam jets which direct steam onto and at right angles to the moving tobacco.

Another means is a vertical metering tube or column with axial perforated steam tube which directs steam transversely to the tobacco flowing down the tube.

Another means is an enclosed rotary screw conveyor with steam jets arranged in the trough and/or lid which are directed at right angles to the transported tobacco.

Another means is a simple horizontal gauze band conveyor with the upper strand conveying tobacco over an open topped plenum chamber fed with steam which passes through the tobacco at right angles to its motion.

To achieve expansion or puffing of the tobacco it is necessary to heat the tobacco near to the boiling point of the moisture within the tobacco, in order to create the conditions for expansion.

Tobacco is a hygroscopic material and below a critical moisture, which for tobacco is around 40 to 50%, the moisture is "bound" and exerts a vapour pressure below that of free water, e.g. it can be held in capillaries where the vapour pressure is lowered by the concave water surface. Above the critical moisture there is also free "unbound" moisture on the surface of the tobacco or held in voids which exerts the full vapour pressure. (See Elements of Chemical Engineering by Badger and McCabe page 299).

In general the tobacco has to be heated above 100 degrees C. to achieve boiling point. In fact the elevation can be deduced from the equilibration moisture curves. For example for a typical grade of cut stem at a cutting moisture of 33% the elevation is 2 degrees C. and at 27% the elevation is 4 degrees C., whilst at the critical moisture content of 46% the boiling point is that of free water. In practice there is a compensation factor:

When a hygroscopic material, like tobacco, below the critical moisture content is heated by saturated steam it will first absorb the condensation moisture (typically 5% to raise it from 20 to 100 degrees C.) and then continue to absorb moisture at a much slower rate by a reverse wet bulb process, driven by the vapour pressure difference between the steam and the tobacco. But in this case the tobacco rises in temperature above the steam in order to transfer the latent heat. Like the wet bulb an equilibrium temperature difference is established at which the flow of heat from the tobacco to the steam equals the latent heat of condensation. In fact the elevation in temperature is very similar to the elevation in boiling point in the example above.

The heating ability of steam is dependent on it being 100% saturated steam; it is reduced by two factors: superheat and air dilution.

Saturated steam is a vapour and transfers heat by condensation. Very high transfer rates are possible, because as the steam condenses to water it releases a large latent heat and also reduces to 0.06% of the volume, so that further steam flows in to fill the void.

Superheated steam on the other hand behaves as a gas and transfers heat by conduction, with correspondingly low heat transfer rates, only around 1% of the rate by condensation. To compensate high temperature differences must be used.

In addition the heat available from the superheat is very small compared with the latent heat, so again high temperatures must be used.

If steam is diluted by air it lowers the dew point, i.e. the temperature at which the air is saturated. The mixture behaves approximately as a gas until saturation is reached and the heat transfer is effected correspondingly.

At saturation the heat transfer is by condensation again, but the presence of the air introduces a surface film through which the steam must diffuse reducing the heat transfer. The maximum temperature to which the tobacco can be heated becomes effectively the dew point of the mixture. For steam with 10% air the dew point is 2 degrees C. below boiling point and for 20% air 4 degrees C. below boiling point.

The aim of the heating means must be to exclude air and to heat all 100% of the tobacco. Two to three times the theoretical steam flow is used to try to achieve these aims. Even so the effectiveness of the different means varies.

A particularly convenient method of heating the tobacco is by means of a vibrating conveyor tray, with perforations in the tray bottom to provide vertical upward currents of steam flowing transversely to the tobacco flow, convenient because the equipment is simple, compact, does not lose tobacco height and is easily cleaned.

Several examples of this means are known, in which relatively few high pressure steam jets (greater than 1 bar and up to 10 bar) are used to heat the tobacco. There are several disadvantages to this high pressure and small number of jets: viz the effect of "spouting" the tobacco is experienced which interferes with the conveying action making it sensitive to tobacco flow rate and encouraging the entrainment of air; the small number of jets reduces the proportion of tobacco treated; and the tobacco tends to cling to the enclosure extending over the conveyor.

There is a theoretical minimum of steam required to heat the tobacco and to 100 degrees C. dependent on the specific heat of the tobacco and temperature rise. For example 1500 kg/hr of cut stem requires 125 kg/hr of steam to heat it from 20 to 100 degrees C. In practice two to three times this amount is used to compensate for short term variation of flow rate, incomplete utilisation and a surplus to exclude the air.

For example the device described in example 2 of Patent No. GB 2138666A utilises 7 rows of 15 holes each of 0.8 mm in diameter in a tray 0.4 m wide×2.0 m long fed with steam at 10 bar square. That is a total steam flow of 220 kg/hr for a tobacco flow rate of 1200 kg/hr, a free area of 0.0066% (area of tray perforated), a mean hole spacing of 94 mm and only 131 holes/$m^2$.

Another manufacturer uses four widely separated rows of closer pitched holes approximately 20 mm apart. In both cases the jets use high pressure steam above 1 bar, which lifts the tobacco intermittently and interferes with the conveying action.

In practice a compromise has to be found between too much steam which prevents conveying too little which gives poor processing. As a result the system is sensitive to tobacco flow rate.

To prevent "spouting" the energy of each jet must be reduced. For a given steam flow and steam pressure this means more jets of smaller diameter and a point is reached where the diameter is impractically small, so that lower steam pressures must be used.

OBJECTS OF THE INVENTION

It is an object of this invention to provide a vibrating conveyor means of heating tobacco with steam which overcomes these disadvantages and thereby increases the tobacco expansion.

More particularly, the object of this invention is to exclude substantially all of the air within the interstices of the tobacco whereby substantially 100% of the tobacco is heated.

According to the invention there is provided a method of conditioning tobacco comprising the steps of a) vibrating tobacco particles by means of a vibratory conveyor to produce a continous stream to be transferred along a predetermined path, the conveyor being vibrated in such a manner that the stream of tobacco particles remains in contact with the supporting surface of the conveyor during transportation, b) contacting substantially all of the particles of tobacco in said path with steam by continuously passing steam upwardly through perforations in said conveyor, and c) maintaining said steam at a pressure sufficient to enable the steam to diffuse into the interstices between the particles without causing said stream of tobacco particles to be lifted out of contact with the supporting surface of the conveyor.

Further according to the invention there is provided an apparatus for conditioning tobacco comprising a) a conveyor having a supporting surface of which at least a portion is perforated, b) means for vibrating the conveyor in such a manner that the stream of tobacco particles are transported along a predetermined path with the stream remaining in contact with the supporting surface of the conveyor, and c) a plenum chamber beneath the perforated portion for supplying the stream to the perforations, d) said perforated portion of the conveyor having a free area of between 0.125% and 2.5%, whereby in use steam at a pressure of from 20 mbar to 1 mbar ensures diffusion of the steam within the interstices of the tobacco particles without causing lifting of the tobacco stream out of contact with the supporting surface of the conveyor.

The steam perforations in the conveyor tray are so proportioned in size and frequency that they provide a diffuse distribution of low pressure steam, typically 5 mbar over the tray surface, which leaves the tobacco in contact with the tray.

The efficiency of the present invention relies upon the feature that the tobacco particles do not become airborne in relation to the vibratory conveyor or become fluidised either as a result of the vibratory motion of the conveyor, i.e. the vertical component must not exceed 1 g, or as a result of the pressure of the entering steam. In the present the tobacco particles move as a "carpet" which effectively "shuffles" along the conveyor surface.

The invention will now be described by way of example with reference to the accompanying drawings in which:

DESCRIPTION OF THE PREFERRED EMBODIMENT

Figure 1:
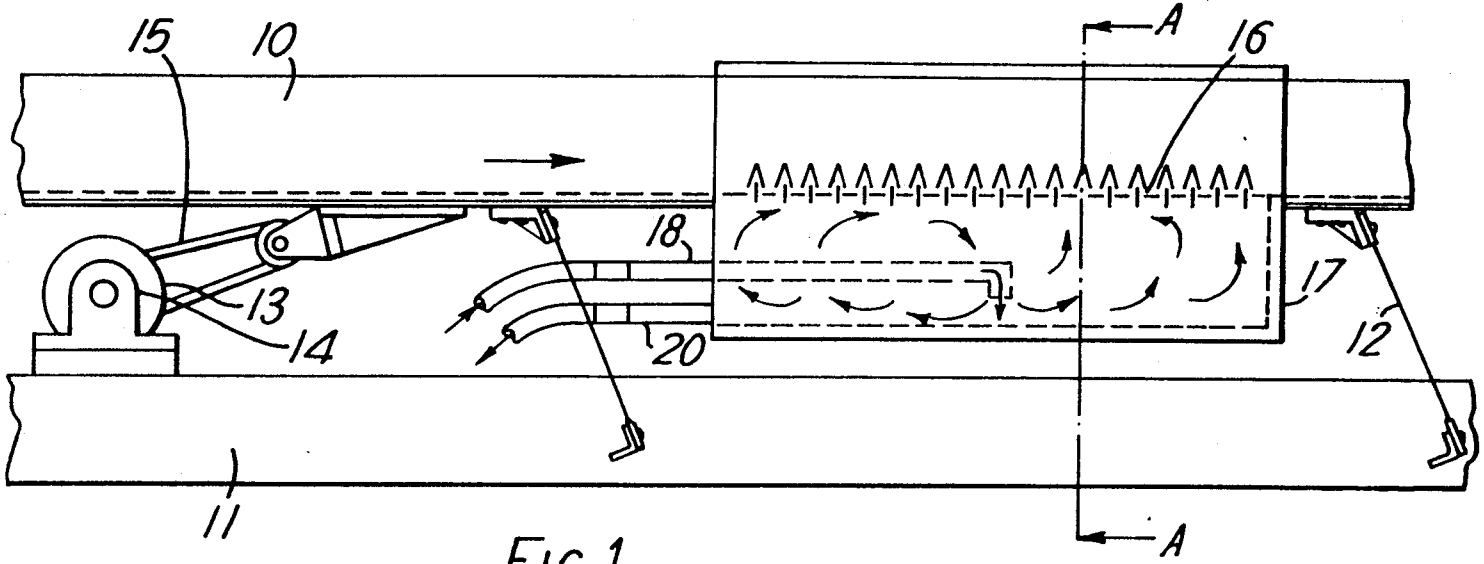
FIG. 1 shows a side elevation in a section of the steaming zone incorporated in a standard vibrating conveyor.
Figure 2:
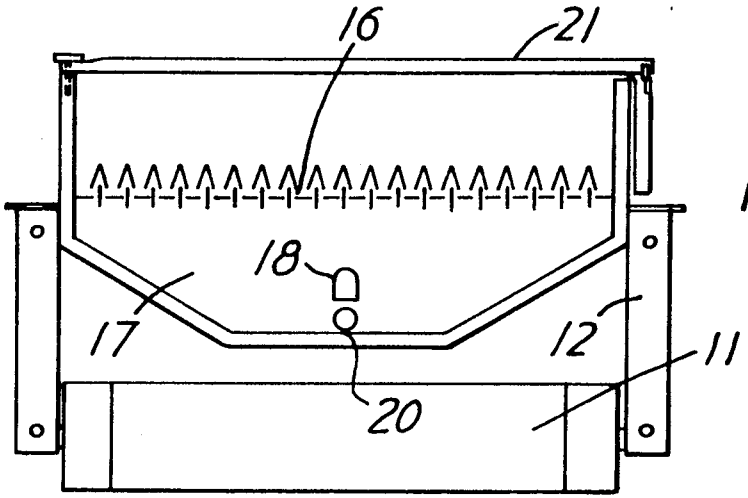
FIG. 2 shows a section taken along line A—A in FIG. 1.

The conditioner of the present invention which includes the above features comprises a vibratory trough 10 mounted on a frame 11 by way of linked 12. The trough is vibrated in known manner by a motor 13 having eccentric means 14 driving in link 15 attached by the trough 10. A similar drive mechanism is disclosed in GB patent specification No. 2138666.

Over a predetermined region of the trough are provided perforations 16 as described above beneath which is arranged a plenum chamber 17 into which steam is fed through a pipe 18 and nozzle 19. Condensate is drained off via an outlet pipe 20.

The trough above the perforated region may be covered by a hinged lid 21.

When required an electric superheater referred to below, but not shown, is provided to supply superheated steam to feed pipe 18.

The proportions of the perforated tray are based on the following considerations:

The air resistance of a cut tobacco layer is proportional to the loading and proportional to the airflow for velocities below 1 m/sec, at which the tobacco is buoyant, i.e. the air resistance equals the weight of the layer. For steam with half the density of air the buoyant velocity is affected by a factor of root 2 which equals 1.4 m/sec.

To ensure positive conveying on a vibrating conveyor and to ensure that dust does not become airborne it is desirable to use only 25% of the buoyant velocity, i.e. 0.35 m/sec. In practice some of the steam condenses on the tobacco, so slightly more can be used.

To ensure a uniform distribution of steam over the surface of the tray which is substantially independent of the uniformity of the tobacco layer, it is necessary to have a perforated plate resistance which is several times the resistance of the tobacco layer.

From above the resistance of a 5 kg/$m^2$ layer (of nominal 50 mm depth) at 25% of buoyant velocity is 1.25 mm WG so as a pressure drop of $10\times1.25-12.5$ mm WG is desirable across the perforated plate.

A steam velocity of 20 m/s has a velocity pressure of 12.5 mm WG, so this velocity through the perforations will give a pressure drop of 12.5 mm WG (1.25 mbar). This velocity is high enough to prevent heavy dust particles from falling through the holes. The mean velocity above the plate is 0.35 m/s so the free area of the plate must be $$\frac{0.35 \times 100}{20} = 1.75\%$$

assuming the perforations are shaped nozzles. For punched holes in perforated plate with a coefficient of discharge of 0.7 the free area is 2.5%.

To heat 1500 kg/hr of cut stem from 20 to 100 degrees C. requires a minimum of 125 kg/hr of steam. Assuming double this use and the velocity conditions described above only 0.33 $m^2$ of steaming area are required. Assuming also a tobacco layer if 5 $kg/m^2$ the process time is only 4 seconds.

In practice a longer time is desirable, up to 10 seconds, to ensure that all the tobacco reaches the ultimate temperature, so up to 2.5×the area is used and the free area reduces to 1.0%.

Furthermore it is often desirable to reduce the steam flow to match a reduced tobacco flow, in which case the hole velocity above should apply to the minimum steam flow. For example a turn down of 4:1 would require a hole velocity of 80 m/s under maximum conditions with a pressure drop of 20 mbar, this further reduces the free area to 0.25%.

To achieve a uniform diffused steam flow above the perforated plate and to avoid "spouting" a large number of very small holes (e.g. from 0.5–1 mm in diameter) at close centres (a pitch of from 8–10 mm) are required. Punching is the most economical way to produce holes. In practice the smallest punched holes are 0.1 mm diameter to give 0.35% free area these are spaced at 9.5 mm staggered pitch, i.e. 12,730 holes/$m^2$. The distribution may be from 1000 to 1500 holes/$m^2$.

A practical limitation is that the maximum thickness of sheet metal that can be punched is equal to the punch diameter or with stainless steel only half the punch diameter. This is generally too thin for a vibrating conveyor tray, so a thicker backing plate is used with larger holes at the same pitch to act as support for the thinner sheet.

Below the perforated tray is a plenum chamber fed with steam at the required flow rate. This steam is fed centrally into the chamber to ensure that there is no swirling of the steam within the chamber which would be imparted to the steam above the perforated plate.

Steam supplies are normally wet, and when used as tobacco processing steam the water droplets are filtered off by the first tobacco. In this case by the bottom layers of the tobacco carpet, which becomes sodden. Wet tobacco collects on the tray bottom and blocks off the perforations. To reduce this the steam is fed via a water separator. However the water separator only removes the larger water droplets and although the plenum chamber and pipework are insulated, further condensation can take place after the separator.

The factory steam supply is usually at several bar pressure. This is dropped to several millibar at the plenum chamber by a fixed orifice or a modulating valve. In either case the factory steam pressure is reduced to virtually atmospheric pressure with consequent throttling and drying of the steam. For example a 6 bar gauge supply when expanded will release enough heat to superheat the steam 44 degrees C. or to dry 4% of water.

There may not be sufficient pressure drop to ensure dryness, in which case an electric superheater may be included in the low pressure steam line. A temperature sensor in the plenum chamber will indicate dry steam by measuring temperatures in excess of 100 degrees C.

Although excessive superheat is detrimental to the process, because of reduced heat transfer explained above, moderate amounts of a few degrees ensure dry operation and do not significantly reduce overall heat transfer.

The plenum chamber is a low pressure vessel fed from a high pressure source. To ensure safety and clear condensate when starting up, the condensate pipe ends in a water trap of 300 mm depth to sustain 25 mbar pressure.

Preferably the perforated portion of a vibrating conveyor tray has a free area between 0.125% and 2.5% fed with low pressure dry saturated steam at between 20 mbar and 1 mbar pressure, and typically 0.5% free area with 5.0 mbar pressure. The perforated plate comprises a large number of small perforations, typically 0.5 mm diameter at 9.5 mm staggered pitch or over 10,000 holes/$m^2$, typically 12,7300 holes/$m^2$.

Smaller holes can be produced in thick sheets by laser drilling, but as only one hole is produced at a time and a large number of holes are required, this is not very economic.

A practical and economic alternative is "Conidur" (Trade Name) fine hole sheet produced Hein, Lehmann AG in Dusseldorf, West Germany. This differs from a normal punched sheet in that no material is removed; instead the sheet is perforated by shearing the sheet for a short distance and then displacing the sheet locally on one side of the shear above the general level of the sheet to produce a triangular to semi-elliptical hole.

In this way holes equivalent to 0.15 mm diameter can be produced in 0.75 mm thick sheet. The holes are directional in that they give a component of flow parallel with the sheet, but this effect is confined to only a short distance from the sheet. The holes are strongly conical with a reduced tendency to clogging.

By means of the invention the tobacco stream remains in contact with the vibrating tray, rendering the process insensitive to tobacco flow rate minimising the entrainment of air and maximising the proportion of tobacco treated.

I claim:

1. A method of conditioning tobacco comprising the steps of, a) vibrating tobacco particles by means of a vibratory conveyor to produce a continuous stream to be transferred along a predetermined path, the conveyor being vibrated in such a manner that the stream of tobacco particles remains in contact with the supporting surface of the conveyor during transportation, b) contacting substantially all of the particles of tobacco in said path with steam by continuously passing steam upwardly through perforations in said conveyor, and c) maintaining said steam at a pressure sufficient to enable the steam to diffuse into the interstices between the particles without causing said stream of tobacco particles to be lifted out of contact with the supporting surface of the conveyor, wherein the steam passing by way of the perforations includes a component of flow parallel with the supporting surface of the conveyor.

2. A method as claimed in claim 1, wherein the steam in a dry saturated condition is supplied at a pressure of between 20 mbar and 1 mbar.

3. An apparatus as claimed in claim 1, wherein the perforations (16) are from 0.1 to 1 mm in diameter, preferably 0.5 mm.

4. An apparatus for conditioning tobacco comprising a) a conveyor (10) having a supporting surface of which at least a portion is perforated, b) means (13, 14, 15) for vibrating the conveyor in such a manner that the stream of tobacco particles are transported along a predetermined path with the stream remaining in contact with the supporting surface of the conveyor, and c) a plenum chamber (17) beneath the perforated portion for supplying the stream to the perforations, d) said perforated portion of the conveyor having a free area of between 0.125% and 2.5%, whereby in use stream at a pressure of from 20 mbar to 1 mbar ensures diffusion of the steam within the interstices of the tobacco particles without causing lifting of the tobacco stream out of contact with the supporting surface of the conveyor.

5. An apparatus as claimed in claim 4, having at least 1000 perforations per square meter.

6. Apparatus as claimed in claim 4, having at least 1200 perforations per square meter.

7. Apparatus as claimed in claim 4, wherein said apertures are so shaped that they cause the stream to include a component of flow parallel with the supporting surface of the conveyor.

* * * * *